US011304531B1

(12) United States Patent
Lopez

(10) Patent No.: US 11,304,531 B1
(45) Date of Patent: Apr. 19, 2022

(54) RAISING MECHANISM FOR SITTING ASSEMBLY

(71) Applicant: Inorca SAS, Cali (CO)

(72) Inventor: Guillermo Lopez, Cali (CO)

( * ) Notice: Subject to any disclaimer, the term of this patent is extended or adjusted under 35 U.S.C. 154(b) by 0 days.

(21) Appl. No.: 17/075,269

(22) Filed: Oct. 20, 2020

(51) Int. Cl.
*A47C 3/36* (2006.01)
*A47C 3/40* (2006.01)

(52) U.S. Cl.
CPC . *A47C 3/36* (2013.01); *A47C 3/40* (2013.01)

(58) Field of Classification Search
CPC ..... B60N 2/162; B60N 2/1635; B60N 2/164; B60N 2/161; B60N 2/1817; B60N 2/508; A47C 3/40; A47C 3/36
USPC ..... 297/344.2, 339, 344.17; 248/405
See application file for complete search history.

(56) References Cited

U.S. PATENT DOCUMENTS 5,265,935 A 11/1993 Geisler et al.
6,170,914 B1 * 1/2001 Chang ..... A47C 3/24 297/339
8,292,368 B1 * 10/2012 Yarbrough ..... A47C 1/029 297/344.12

FOREIGN PATENT DOCUMENTS

CN 107928893 A * 4/2018
JP 06038852 A * 2/1994 ..... A47C 3/36

* cited by examiner

*Primary Examiner* — Milton Nelson, Jr.
(74) *Attorney, Agent, or Firm* — Sanchelima & Associates, P.A.; Christian Sanchelima; Jesus Sanchelima

(57) ABSTRACT

A volumetrically efficient mechanism for raising and lowering sitting assemblies to provide ready access below them. A scissors assembly is selectively moved from a collapsible to an extended (raised) configuration by an electric motor with a telescopic arm that acts on hingedly mounted U-shape frames. The distal ends of the frames include wheels that ride over a lower support assembly. The telescopic arm is mounted to one of the distal upper member of the frames and the motor is rigidly mounted to the upper end of the other U-shape frame or to the lower support assembly causing them to selectively move between the two extreme configurations.

2 Claims, 19 Drawing Sheets

RAISING MECHANISM FOR SITTING ASSEMBLY

BACKGROUND OF THE INVENTION

1. Field of the Invention

The present invention relates to a novel mechanism for raising a sitting assembly.

2. Description of the Related Art

Several designs for raising seat assemblies from the supporting surface have been designed in the past. These mechanisms are desirable for easily cleaning and maintenance purposes, especially in theaters, auditoriums and similar places with a great number of seating assemblies. None of them, however, include a volumetric efficient mechanism with minimum footprint and number of parts.

Applicant believes that a related reference corresponds to U.S. Pat. No. 5,265,935A issued to Geisler et al for a Stand-Assist Recliner Chair. However, it differs from the present invention because the Geisler reference discloses a different and more complicated mechanism and also lacks the volumetric efficiency of the present invention. The present invention provides a simple and practical solution as a self-contained raising mechanism requiring a minimum footprint. And it is still strong enough to raise and lower relatively heavy sitting assemblies.

Other documents describing the closest subject matter provide for a number of more or less complicated features that fail to solve the problem in an efficient and economical way.

None of these patents suggest the novel features of the present invention.

SUMMARY OF THE INVENTION

It is one of the main objects of the present invention to provide a raising mechanism for seating assemblies that is volumetrically efficient and utilizes a minimum number of parts.

It still another object of the present invention to provide a mechanism that uniformly lifts a sitting assembly to a predetermined distance from a supporting surface keeping a substantially parallel and spaced apart relationship.

It is another object of this invention to provide such a mechanism that allows users to have access below the sitting structure for the purposes of cleaning and maintenance of the seating assemblies.

It is yet another object of this invention to provide such a mechanism that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
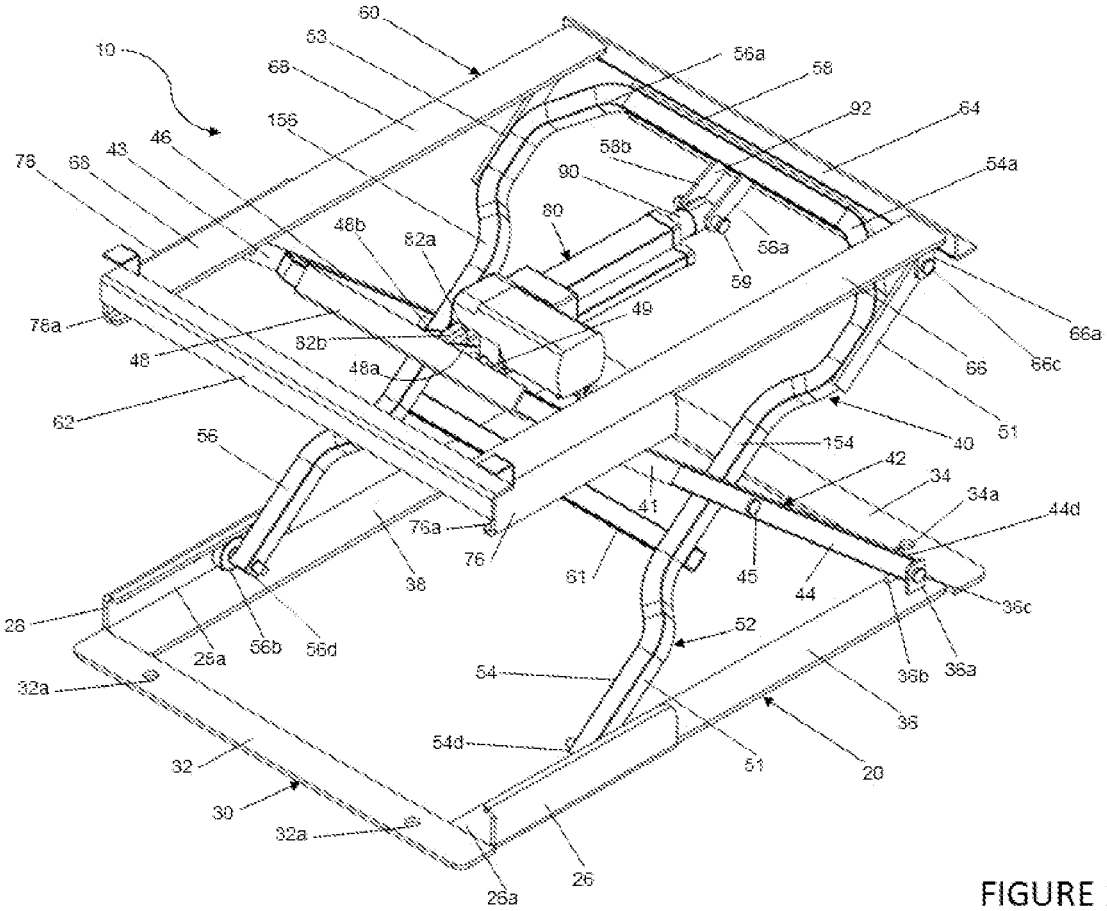
FIG. 1 represents an isometric view of a preferred embodiment for mechanism 10 subject of the present application incorporating the invention

Referring now to the drawings, where the present invention is generally referred to with numeral 10, it can be observed that it basically includes lower support assembly 20; a scissors assembly 40 mounted thereto and adapted to move between two extreme positions, upper support assembly 60 mounted to scissors assembly 40 and kept at a parallel and spaced apart relationship with respect to assembly 20, a motor assembly 80 including a telescopically extendable arm 90 that coacts with the distal ends of lazy scissors assembly 40.

Lower support assembly 20 includes frame member 30 designed to rest on a substantially flat supporting surface. Frame member 30 includes front bar 32, rear bar 34 and side bars 36 and 38 defining a rectangular projected shape, as best seen in FIG. 1. Front bars 32 and 34 include through openings 32*a* and 34*a*, respectively, to facilitate the anchorage (not shown) of assembly 20 to a supporting flat surface S. Guiding channels 26 and 28 extended upwardly from the outer edges of side bars 36 and 38, respectively. Guiding channels 26 and 28 have preferably the same dimensions and are mounted at a predetermined distance from the corners defined by front bar 32 and side bars 36 and 38, respectively. The concave sides 26*a* and 28*a* of channels 26 and 28 face inwardly in frame member 30.

Figure 2:
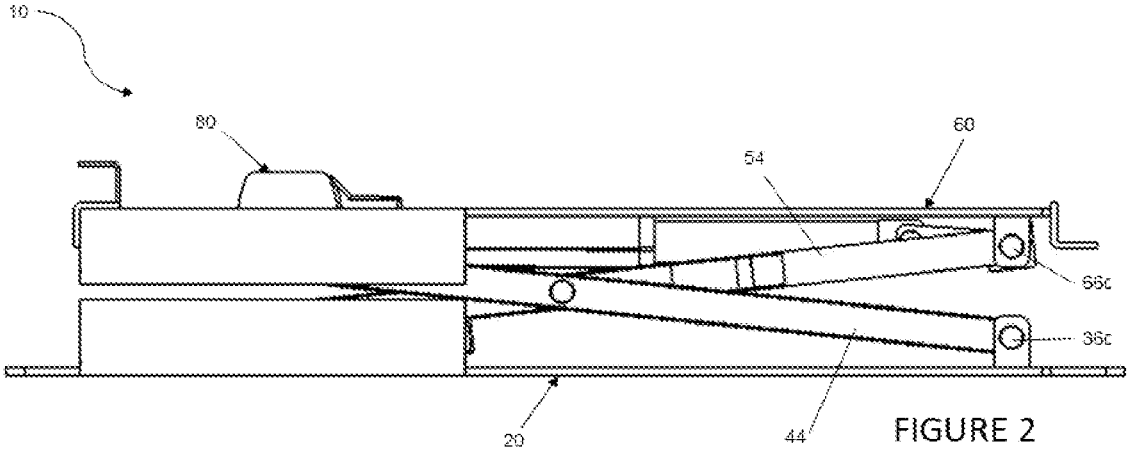
FIG. 2 shows a side elevational view of mechanism 10 shown in the previous figure in the collapsed configuration.
Figure 3:
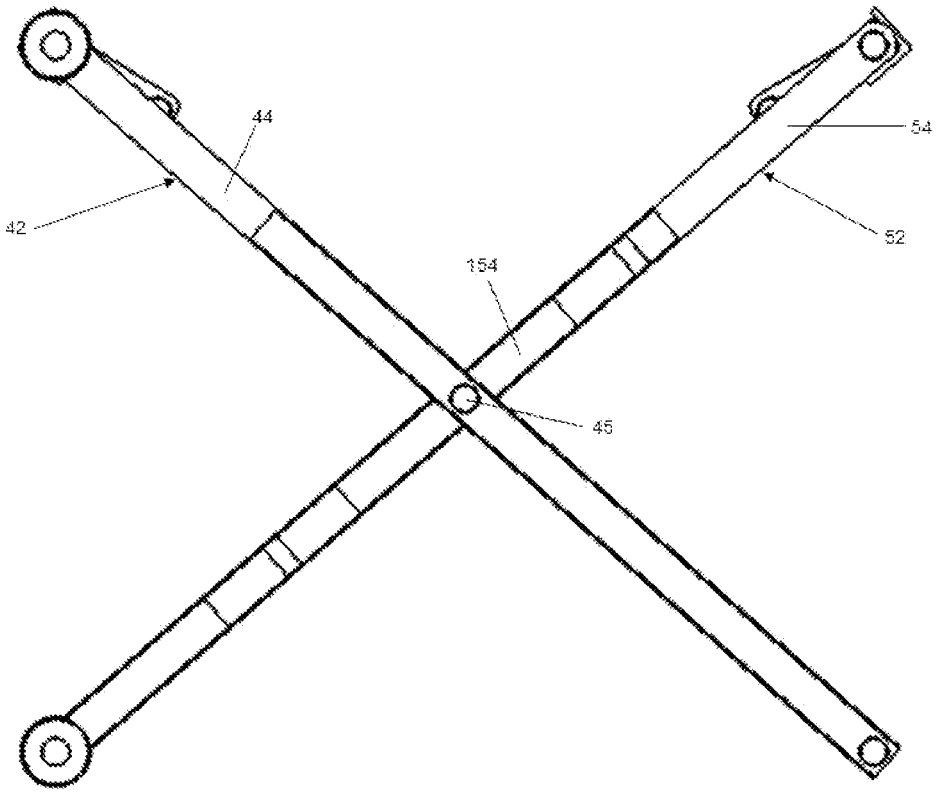
FIG. 3 illustrates a side elevational view of scissors assembly 40 in the raised configuration.
Figure 3A:
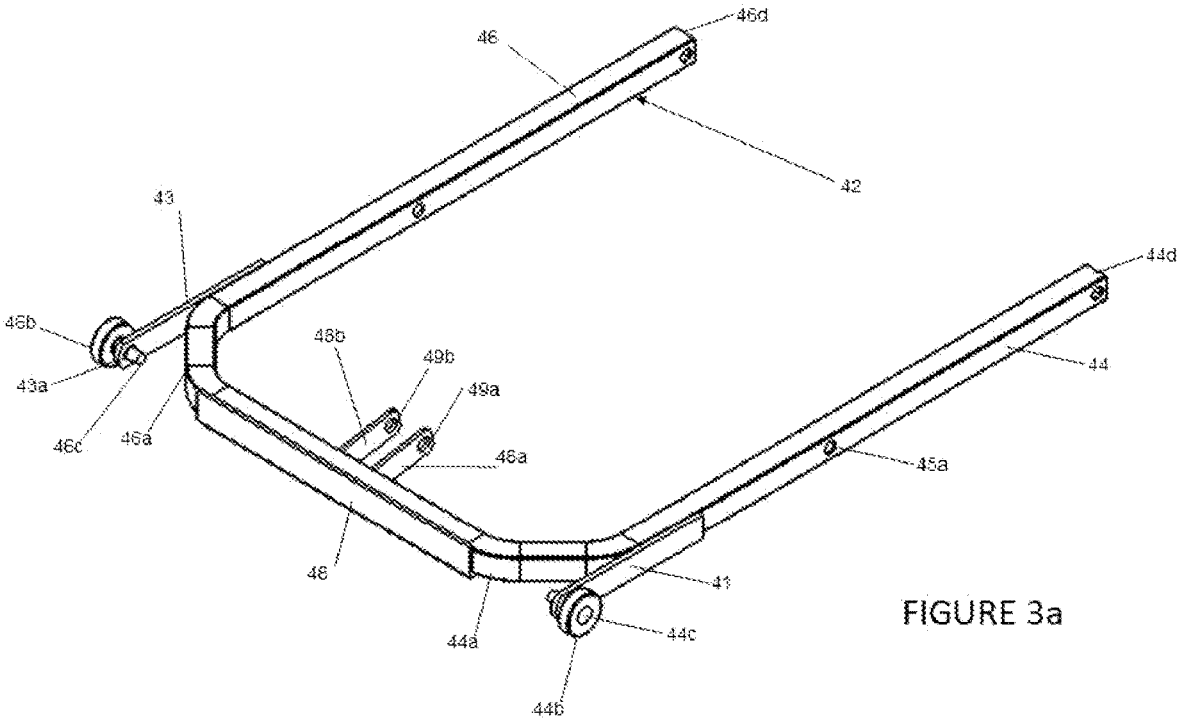
FIG. 3A shows an isometric inclined view of U-shape frame 42.

Scissors assembly 40 comprises U-shape frame 42 and U-shape frame 52 that are hingedly mounted to each other, as best seen in FIGS. 2 and 3. Frame 42 has legs 44 and 46 that are kept at a parallel and spaced apart relationship with respect to each other by transversal member 48, as seen in FIG. 3A. Transversal member 48 includes spaced apart and perpendicularly extending bearing plates 48*a* and 48*b* with coaxially disposed through holes 49*a* and 49*b* for cooperatively receiving pin 49, as seen in FIG. 1. Legs 44 and 46 include rigid arms 41 and 43, respectively, that are rigidly mounted to the outer surface of legs 44 and 46 extending parallel thereto a predetermined distance towards connected ends 44*a* and 46*a*, respectively. Through openings 41*a* and 43*a* are positioned adjacent to the distal ends of arms 41 and 43. Wheels 44*b* and 46*b* are rotatably and outwardly mounted to pins 44*c* and 46*c*, respectively, that are passed through through openings 41*a* and 43*a*, respectively, as best seen in FIG. 3A. Wheels 44*b* and 46*b* can be implemented preferably with ball bearing features in one of the preferred embodiments. Wheels 44*b* and 46*b* are housed, at least partially, within the concave sides 76*a* and 78*a* of guiding channels 76 and 78, respectively, as best seen in FIG. 1.

Figure 8:
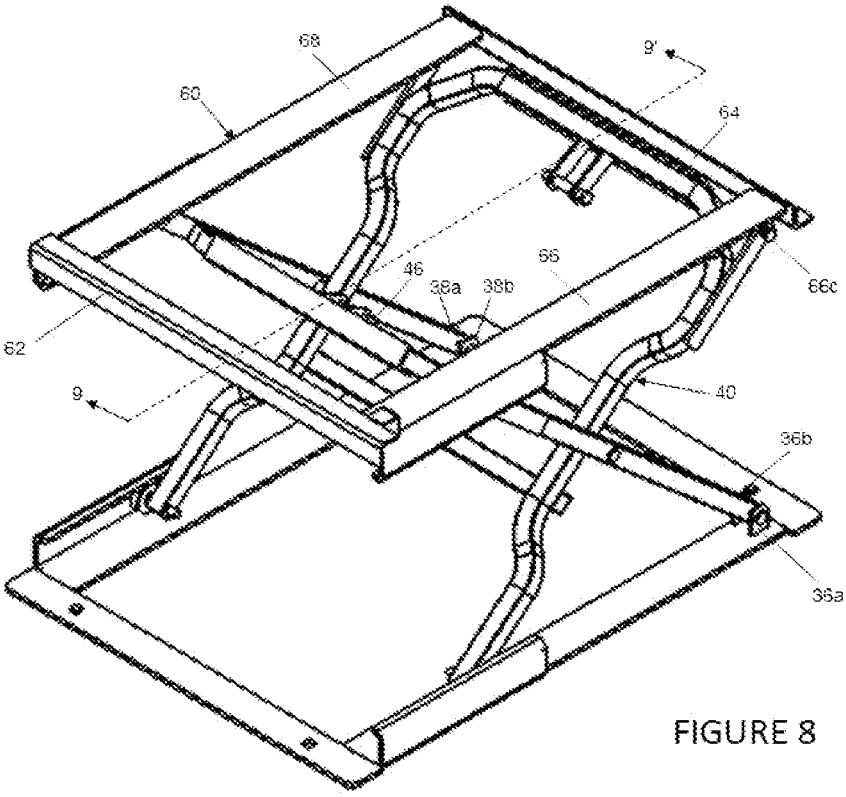
FIG. 8 is an inclined isometric view of scissors assembly 40 with upper support assembly 60 mounted thereon and showing section cutting 9-9'.
Figure 9:
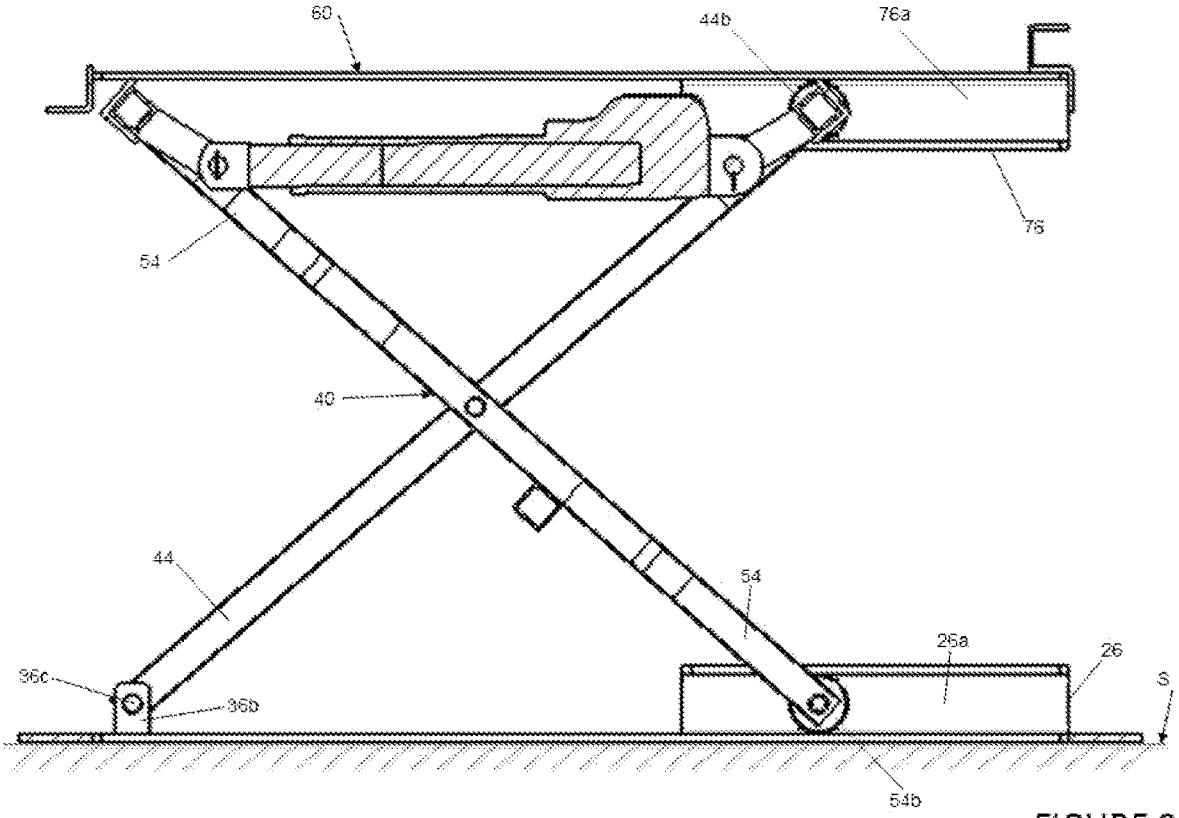
FIG. 9 is a cross-sectional view taken along cutting line 9-9' of scissors assembly 40 represented in FIG. 8.
Figure 10:
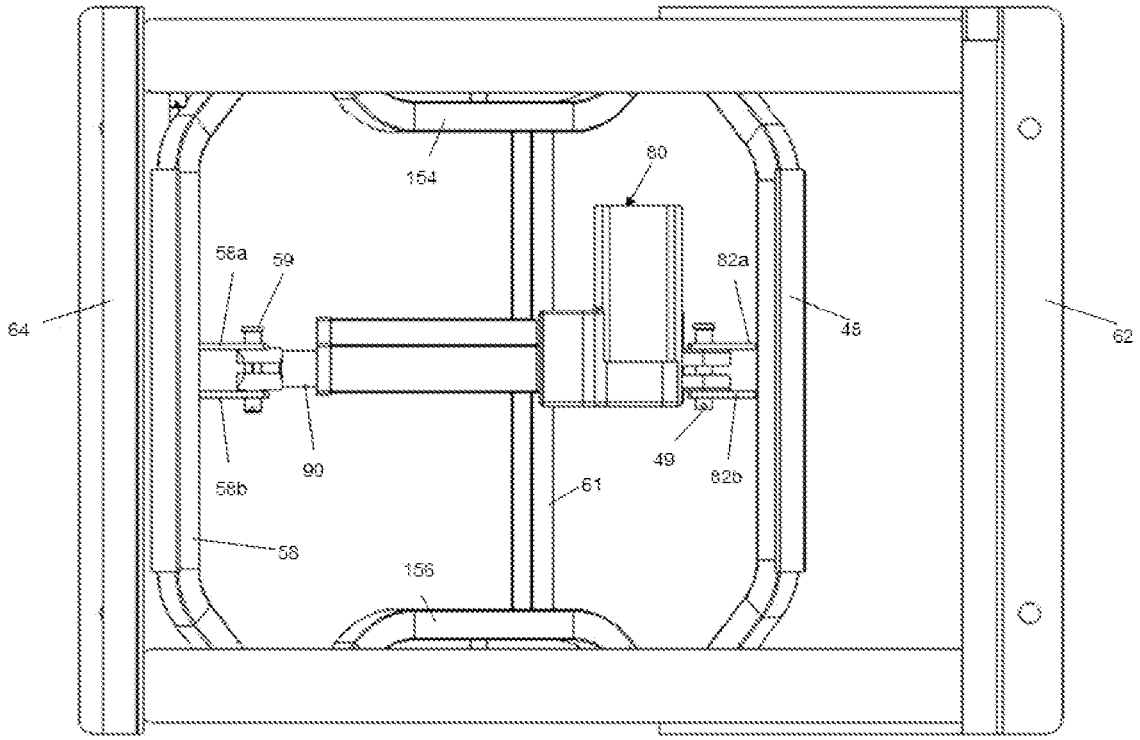
FIG. 10 is a top view of mechanism 10 in the raised configuration.
Figure 11:
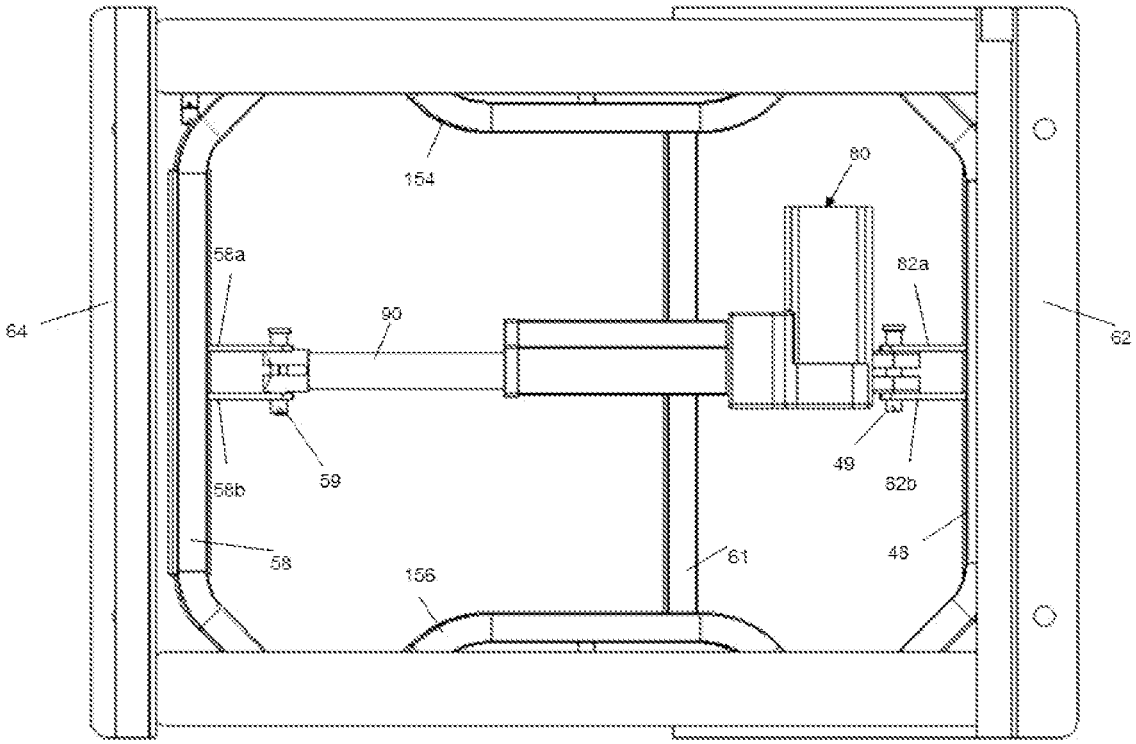
FIG. 11 is a top view similar to FIG. 10 with mechanism 10 collapsed.
Figure 12:
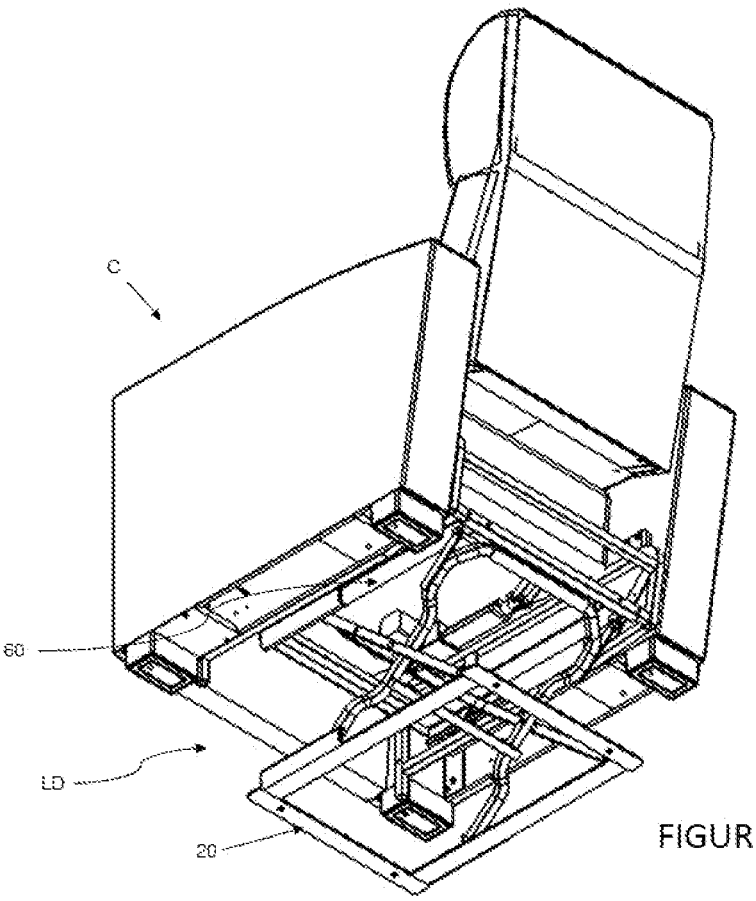
FIG. 12 is an isometric view of the mechanism mounted to a sitting assembly as seen from the bottom.

The distal end 44*d* of leg 44 is pivotally mounted to bearing plates 36*a* and 36*b* with pin 36*c*. Similarly, the distal end 46*d* of leg 46 is pivotally mounted to bearing plates 38*a* and 38*b* with pin 38*c*, as best seen in FIG. 8. Bearing plates 36*a*; 36*b*; 38*a* and 38*b* are mounted on members 36 and 38, at a predetermined distance from the corners defined by rear bar 34 with side bars 36 and 38, respectively.

Figure 3B:
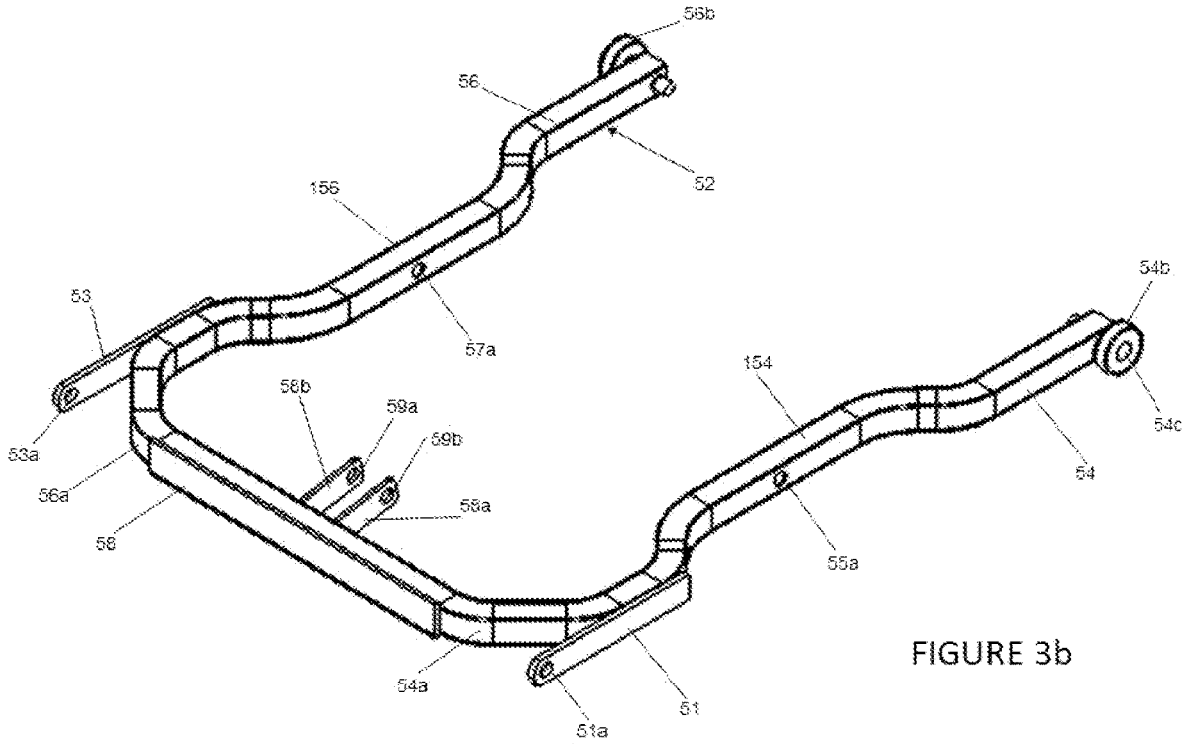
FIG. 3B shows an isometric inclined view of U-shape frame 52.
Figure 4:
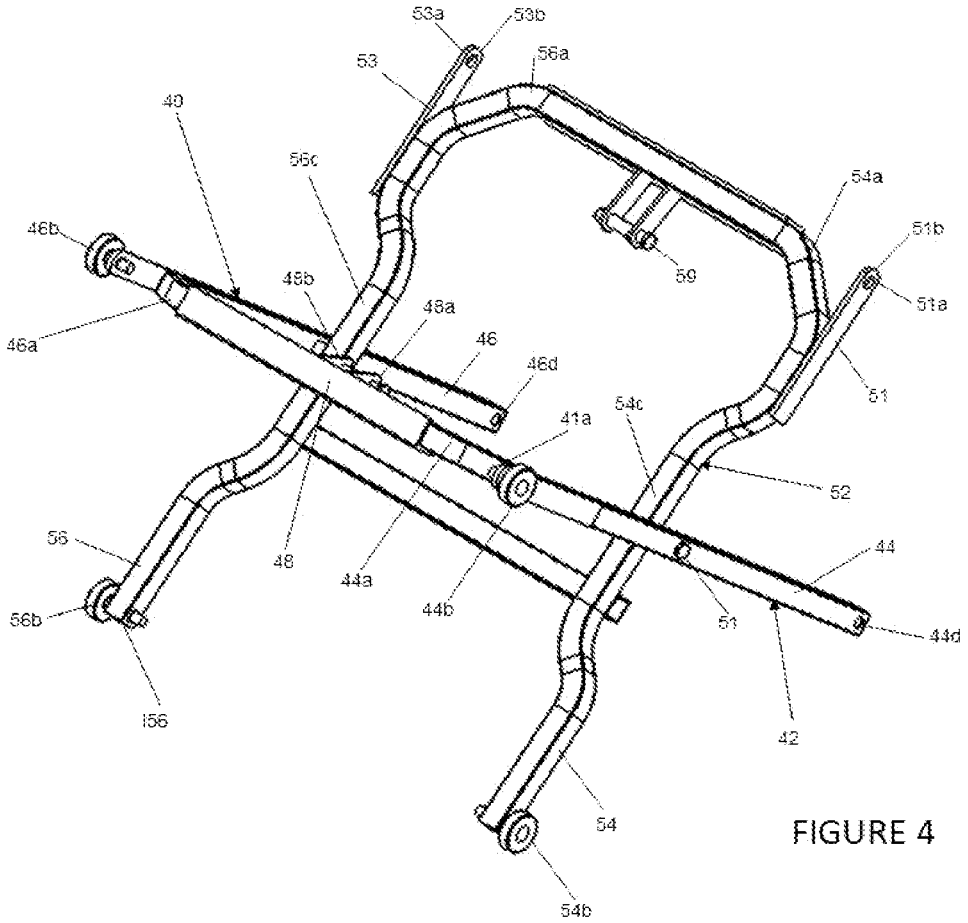
FIG. 4 is a representation of an isometric view of scissors assembly 40 shown in the previous figure.
Figure 5:
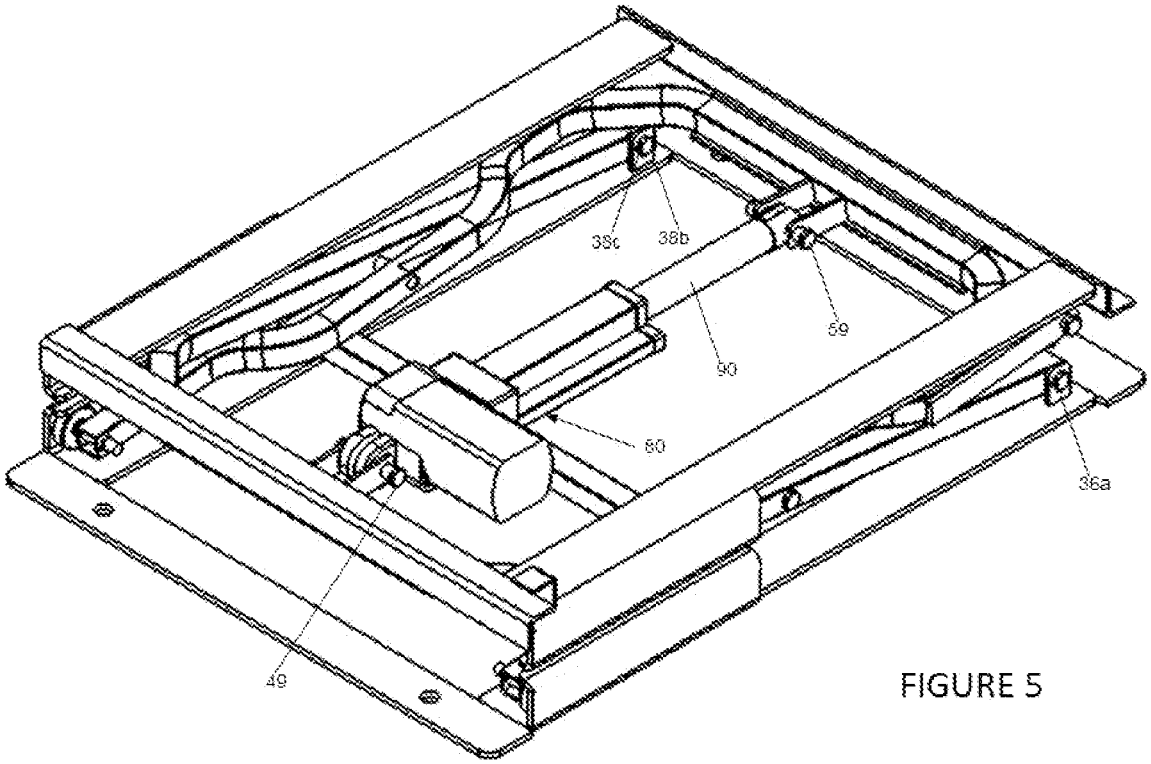
FIG. 5 is an inclined isometric view of the mechanism 10 shown in FIG. 1 in the collapsed configuration.
Figure 6:
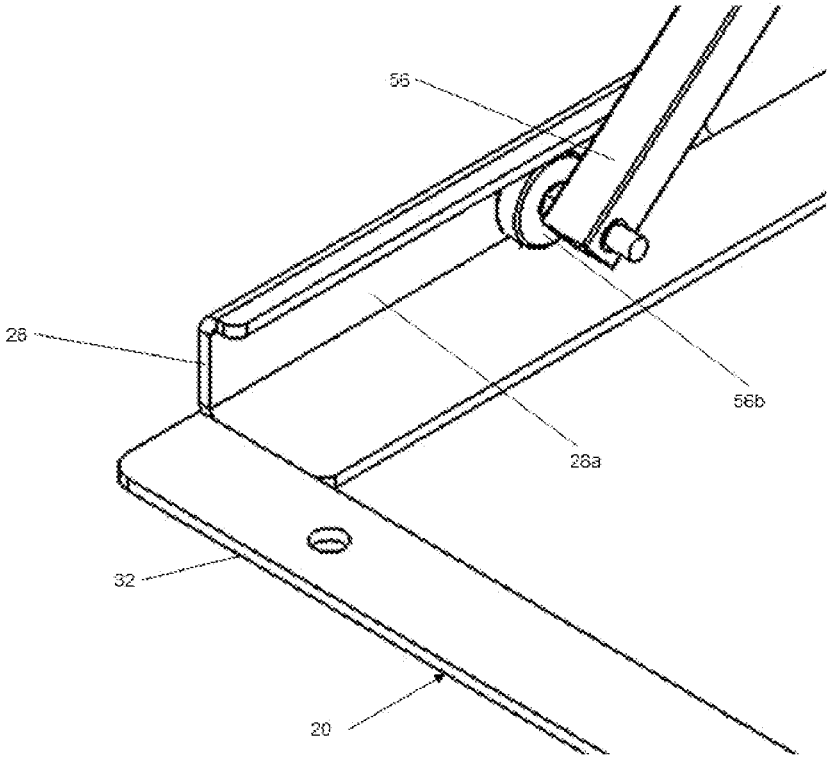
FIG. 6 is an enlarged detail view of the corner of lower supporting assembly 20 with the perpendicularly extending guiding channel 28 partially housing therein wheel 56*b* rotatably mounted to the end of the U-shape frame 56.
Figure 7:
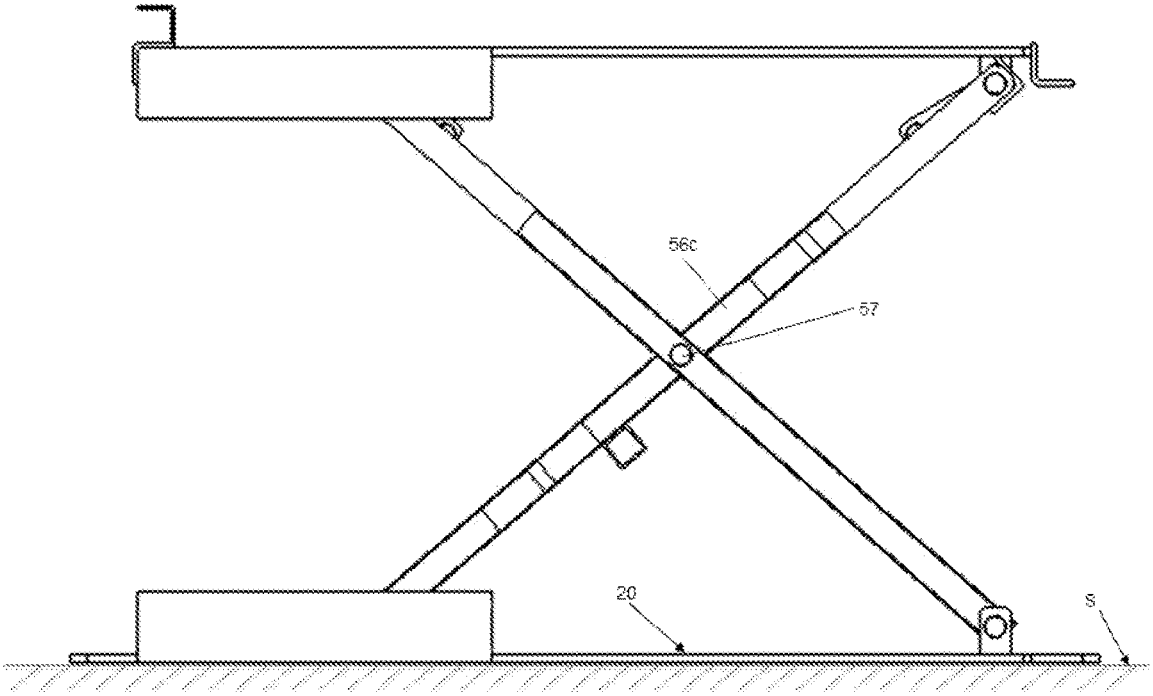
FIG. 7 is an elevational view of scissors assembly 40.

Similarly, as seen in FIG. 3B, frame 52 has legs 54 and 56 that are kept at a parallel and spaced apart relationship with respect to each other by transversal member 58. Legs 54 and 56 have the same length as legs 44 and 46. The former include centrally located and inwardly extending curved portions 154 and 156, as best seen in FIG. 3B. A reinforcement bar 61 can be rigidly mounted between curved portions 154 and 156 to ensure the structural stability of frame 52. Transversal member 58 includes spaced apart plates 58*a* and 58*b* with coaxially disposed through holes 59*a* and 59*b* for cooperatively receiving pin 59, as seen in FIG. 1. Legs 54 and 56 include arms 51 and 53, respectively, that are rigidly mounted to the outer surface of legs 54 and 56 and extending parallel thereto and extending a predetermined distance towards connected ends 54*a* and 56*a*, respectively. Through openings 51*a* and 53*a* are positioned adjacent to the distal ends of arms 51 and 53. Wheels 54*b* and 56*b* are rotatably and outwardly mounted to pins 54*c* and 56*c*, respectively, that are passed through through openings 154 and 156, respectively, as best seen in FIG. 3B. through openings 154 and 156 are located at a predetermined distance from distal ends 54*d* and 56*d*, respectively.

Wheels 54*b* and 56*b* can be implemented preferably with ball bearing features in one of the preferred embodiments. Wheels 54*b* and 56*b* are housed, at least partially, within the concave sides 26*a* and 28*a* of guiding channels 26 and 28, respectively, as best seen in FIG. 1.

Pin 45 is passed through through holes 45*a* and 55*a* and is mounted to legs 44 and 54 allowing the latter to pivot about the former. Pin 57 is passed through through holes 47*a* and 57*a* and is mounted to legs 46 and 56 allowing the latter to pivot about the former, as best seen in FIGS. 3A and 3B. Frames 42 and 52 have substantially the same dimensions.

The distal end 54*a* of leg 54 is pivotally mounted to bearing plates 66*a* and 66*b* with pin 66*c*. Bearing plates 36*a* and 38*a* are mounted at a predetermined distance from the corners defined by rear bar 64 with side bar 66.

The distal end 56*a* of leg 56 is pivotally mounted to bearing plates 68*a* and 68*b* with pin 68*c*. Bearing plates 68*a* and 68*b* are mounted at a predetermined distance from the corners defined by rear bar 64 with side bar 68.

In operation, scissors assembly 20 will move between two extreme configurations, namely, a collapsed configuration and a fully extended configuration, as seen in FIGS. 1 and 2. Wheels 44*b* and 46*b* move to an extreme position within concave sides 26*a* and 36*a*, respectively, near front bar 32 when scissors assembly 20 is in the collapsed configuration.

Upper support assembly 60 mounted ton top of scissors assembly 40. Upper support assembly 60 includes front, rear and side structural members 62; 64; 66 and 68, respectively, as best seen in FIG. 8. These members 62; 64; 66 and 68 are mounted to form a rectangular frame to support sitting assemblies, such as, theater chairs, and the like.

Motor assembly 80 is implemented, in one of the preferred embodiments, with a single actuator drive motor assembly such as those commercialize by Limoss GmbH & Co. KG, Oberwengerner Straße 204, 58300 Wetter, Germany under model No. MD100, or equivalent. The end 92 of extendable arm 90 coupled to motor assembly 80 is hingedly mounted to bearing plates 58*a* and 58*b* with pin 59. Housing 82 of motor assembly 80 include bearing ears 82*a* and 82*b* that cooperate with spaced apart bearing plates 48*a* and 48*b* to allow pin 49 to pass therethrough keeping motor assembly 80 hingedly mounted to transversal member 48. In this manner, motor assembly 80 provides the necessary force to pull and push away transversal members 48 and 58 towards and away from each other. This in turn causes scissors assembly 40 to move from one extreme configuration (collapsed) to the other extreme configuration (fully extended).

Motor assembly 80 is preferably powered by an AC electrical source that is controlled with control unit 99. Control unit 99 selectively switches on and off the application to supply electrical power to motor assembly 80. Control unit 80 can also be wirelessly controlled and/or connected to LAN or WAN networks to facilitate its operation. Banks of mechanisms 10 can be controlled in parallel or individually, as desired, with suitable computerized means depending on the application.

Figure 13:
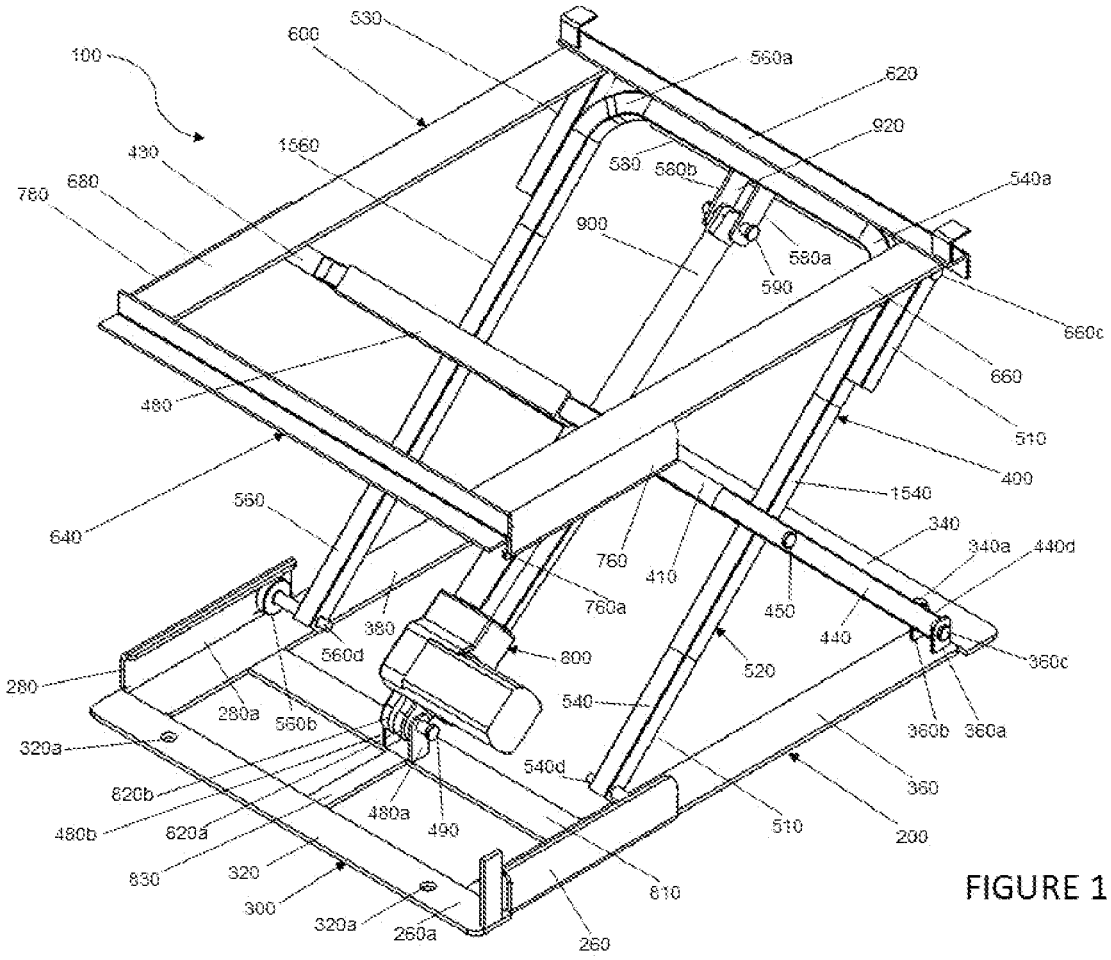
FIG. 13 represents an isometric view, similar to FIG. 1, showing an alternate embodiment for mechanism 100 subject of the present application incorporating the invention and with motor assembly 800 mounted in a different position.

An alternate embodiment referred to as mechanism 100 is shown in FIGS. 13 through 17 where motor assembly 800, similar to motor assembly 80, is mounted in a different position. Alternate mechanism 100 includes lower support assembly 200; a scissors assembly 400 mounted thereto and adapted to move between two extreme positions, upper support assembly 600 mounted to scissors assembly 400 and kept at a parallel and spaced apart relationship with respect to assembly 200, a motor assembly 800 including a telescopically extendable arm 900 that coacts with the distal ends of lazy scissors assembly 400, as best seen in FIG. 13.

Figure 14:
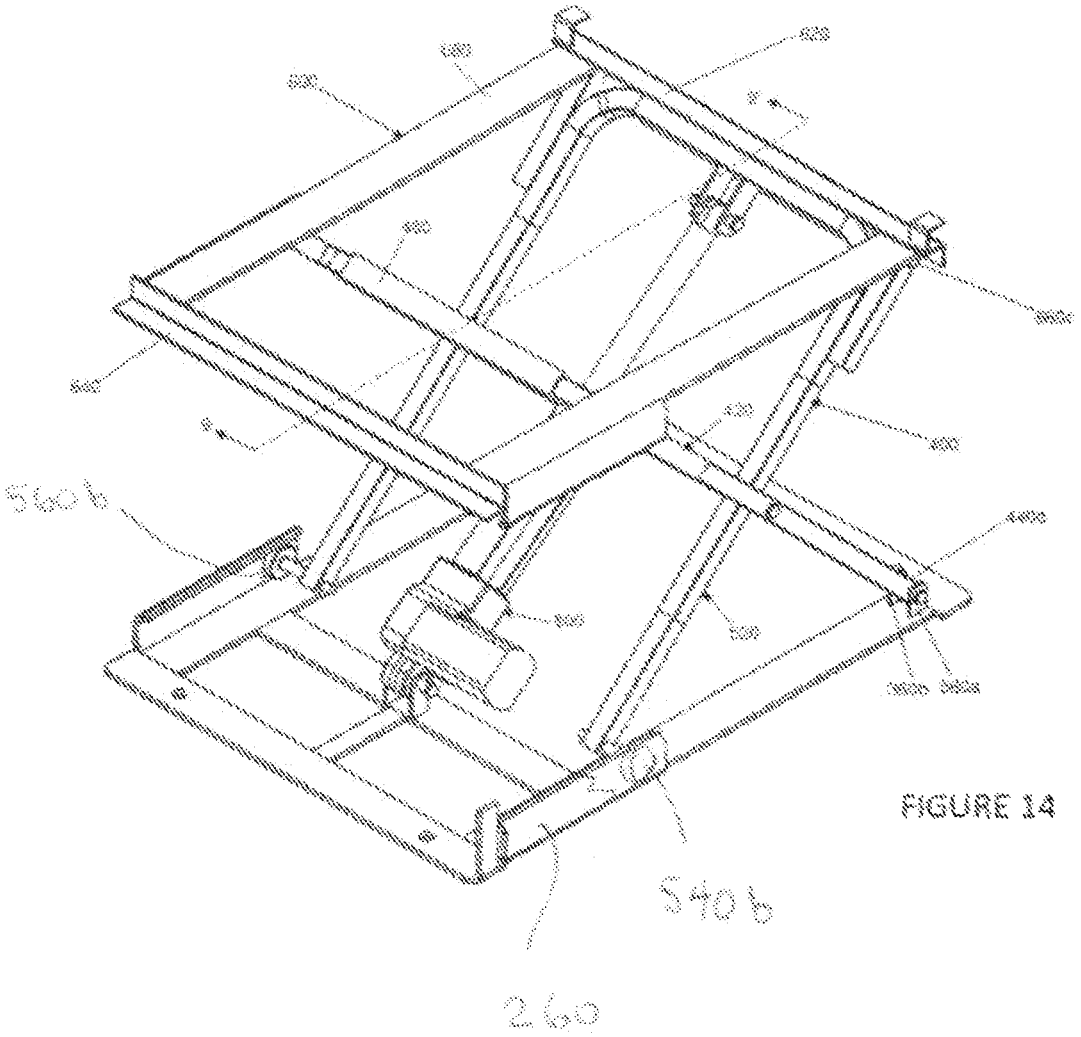
FIG. 14 is an inclined isometric view, similar to FIG. 8, of scissors assembly 140 with upper support assembly 160 mounted thereon in the alternate embodiment and showing section cutting 15-15'.

Lower support assembly 200 includes frame member 300 designed to rest on a substantially flat supporting surface. Frame member 300 includes front bar 320, rear bar 340 and side bars 360 and 380 defining a rectangular projected shape, as best seen in FIGS. 13 and 14. Front bars 320 and 340 include through openings 320*a* and 340*a*, respectively, to facilitate the anchorage (not shown) of assembly 200 to a supporting flat surface S (shown in FIG. 15). Guiding channels 260 and 280 extended upwardly from the outer edges of side bars 360 and 380, respectively. Guiding channels 260 and 280 have preferably the same dimensions and are mounted at a predetermined distance from the corners defined by front bar 320 and side bars 360 and 380, respectively. The concave sides 260*a* and 280*a* of channels 260 and 280 face inwardly in frame member 300.

Scissors assembly 400 comprises U-shape frame 420 and U-shape frame 520 that are hingedly mounted to each other, as best seen in FIGS. 13 and 14. Frame 420 has legs 440 and 460 (shown in FIG. 15) that are kept at a parallel and spaced apart relationship with respect to each other by transversal member 480, as seen in FIG. 13.

Transversal member 810, in the alternate embodiment, is perpendicularly and rigidly mounted to side bars 360 and 380, as seen in FIGS. 13 and 14. Transversal member 810 includes spaced apart and perpendicularly extending bearing plates 480*a* and 480*b* with coaxially disposed through holes 490*a* and 490*b* for cooperatively receiving pin 490, as seen in FIG. 13. Motor assembly 800 includes ear plates 820*a* and 820*b* with through holes (not shown) that are cooperatively aligned with through holes 490*a* and 490*b*, to allow pin 490 to pass through. Reinforcement member 830 is optionally used to ensure the structural stability of mechanism 100 when motor assembly 800 pushes or pull transversal member 810.

Legs 440 and 460 include rigid arms 410 and 430, respectively, that are rigidly mounted to the outer surface of legs 440 and 460 extending parallel thereto a predetermined distance towards connected ends 440*a* and 460*a*, respectively. Through openings 410*a* and 430*a* are positioned adjacent to the distal ends of arms 410 and 430. Wheels 440*b* and 460*b* are rotatably and outwardly mounted to pins 440*c* and 460*c*, respectively, that are passed through through openings 410*a* and 430*a*, respectively, as best seen in FIG. 3A. Wheels 440*b* and 460*b* can be implemented preferably with ball bearing features in one of the preferred embodiments. Wheels 440*b* and 460*b* are housed, at least partially, within the concave sides 760*a* and 780*a* of guiding channels 760 and 780, respectively, as best seen in FIG. 13.

The distal end 440*d* of leg 440 is pivotally mounted to bearing plates 360*a* and 360*b* with pin 360*c*. Similarly, the distal end 460*d* of leg 460 is pivotally mounted to bearing plates 380*a* and 380*b* with pin 380*c*, as best seen in FIG. 8. Bearing plates 360*a*; 360*b*; 380*a* and 380*b* are mounted on members 360 and 380, at a predetermined distance from the corners defined by rear bar 340 with side bars 360 and 380, respectively.

Similarly, as seen in FIG. 13, frame 520 has legs 540 and 560 that are kept at a parallel and spaced apart relationship with respect to each other by transversal member 580. Legs 540 and 560 have the same length as legs 440 and 460. The former include centrally located and inwardly extending curved portions 1540 and 1560, as best seen in FIGS. 13 and 14. Transversal member 580 includes spaced apart plates 580*a* and 580*b* with coaxially disposed through holes 590*a* and 590*b* for cooperatively receiving pin 590, as seen in FIG. 13. Legs 540 and 560 include arms 510 and 530, respectively, that are rigidly mounted to the outer surface of legs 540 and 560 and extending parallel thereto and extending a predetermined distance towards connected ends 540*a* and 560*a*, respectively. Through openings 510*a* and 530*a* are positioned adjacent to the distal ends of arms 510 and 530. Wheels 540*b* and 560*b* are rotatably and outwardly mounted to pins 540*c* and 560*c*, respectively, that are passed through through openings 1540 and 1560, respectively, as best seen in FIG. 13. through openings 1540 and 1560 are located at a predetermined distance from distal ends 540*d* and 560*d*, respectively.

Figure 15:
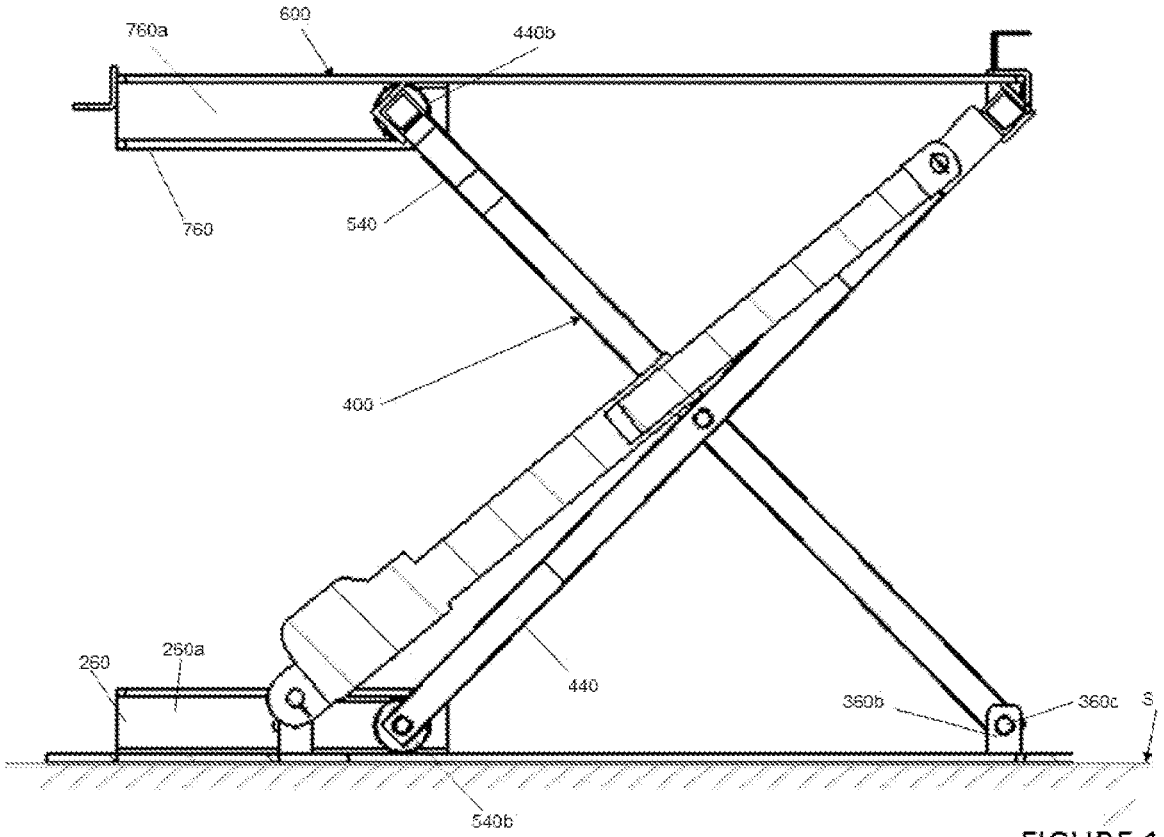
FIG. 15 is a cross-sectional view taken along cutting line 15-15' of scissors assembly 140 represented in FIG. 14.
Figure 16:
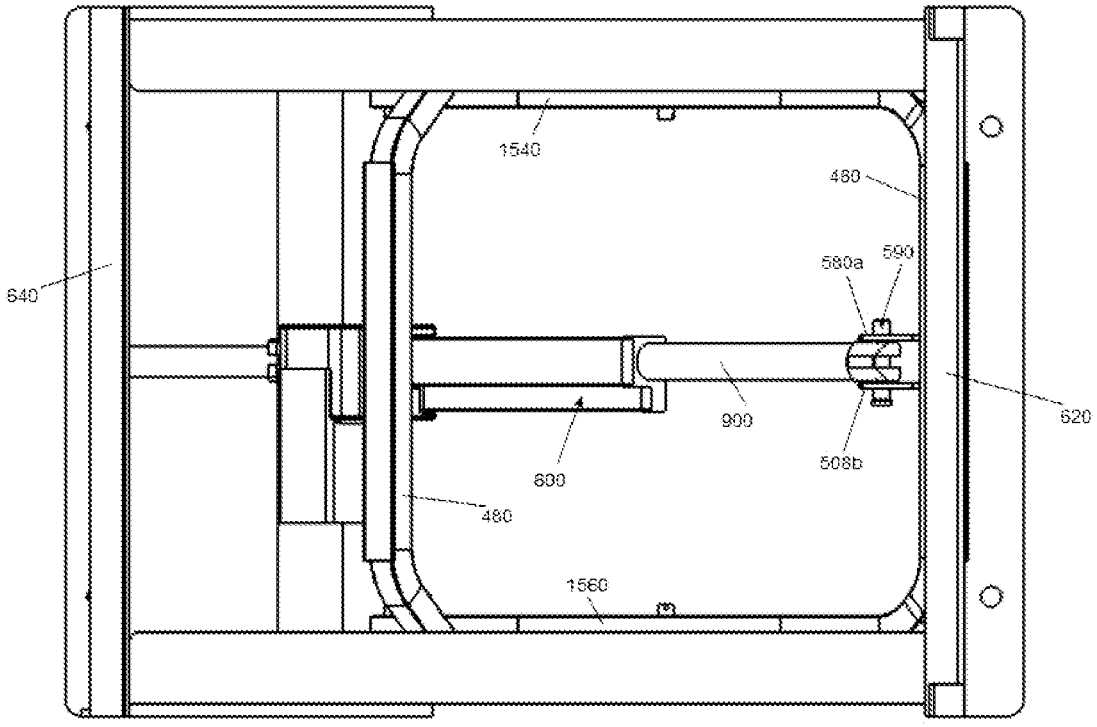
FIG. 16 is a top view, similar to FIG. 10, of alternate mechanism 100 in the raised configuration.
Figure 17:
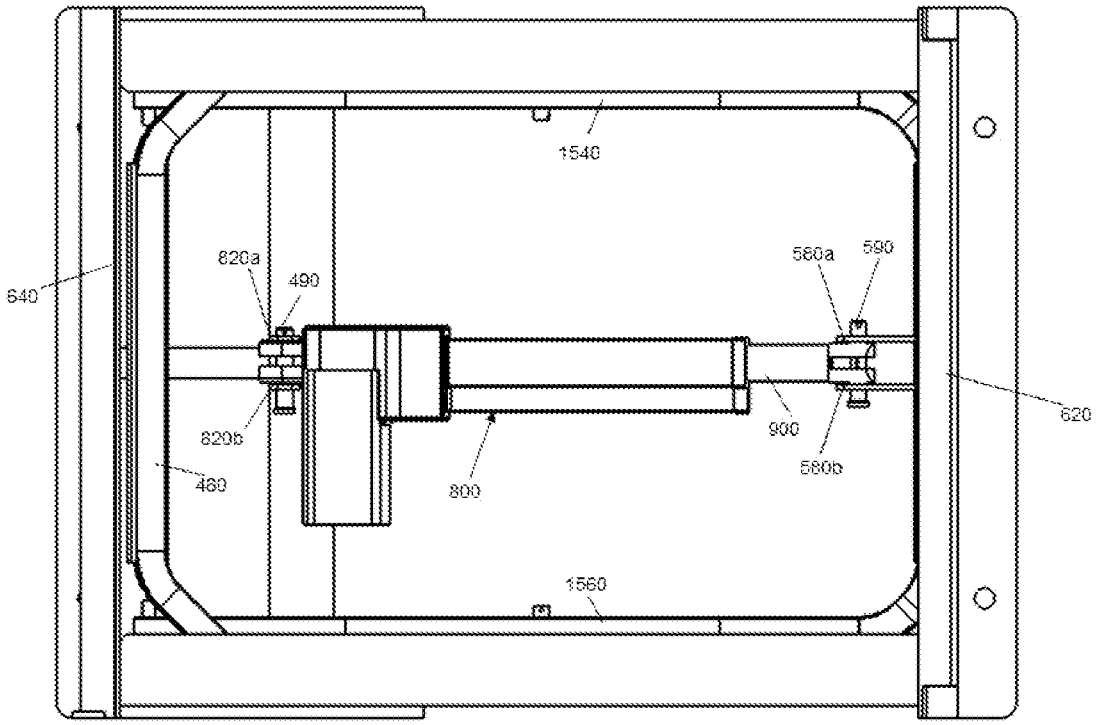
FIG. 17 is a top view, similar to FIG. 11, with mechanism 100 collapsed.

Wheels 540*b* and 560*b* can be implemented preferably with ball bearing features in one of the preferred embodiments. Wheels 540*b* and 560*b* are housed, at least partially, within the concave sides 260*a* and 280*a* of guiding channels 260 and 280, respectively, as best seen in FIGS. 13 and 15.

Pin 450 is passed through through holes 450*a* and 550*a* and is mounted to legs 440 and 540 allowing the latter to pivot about the former. Pin 570 is passed through through holes 470*a* and 570*a* and is mounted to legs 460 and 560 allowing the latter to pivot about the former, as best seen in FIGS. 13 and 14. Frames 420 and 520 have substantially the same dimensions.

The distal end 540*a* of leg 540 is pivotally mounted to bearing plates 660*a* and 660*b* with pin 660*c*. Bearing plates 360*a* and 380*a* are mounted at a predetermined distance from the corners defined by rear bar 640 with side bar 660.

The distal end 560*a* of leg 560 is pivotally mounted to bearing plates 680*a* and 680*b* with pin 680*c*. Bearing plates 680*a* and 680*b* are mounted at a predetermined distance from the corners defined by rear bar 640 with side bar 680.

In operation, scissors assembly 200 will move between two extreme configurations, namely, a collapsed configuration and a fully extended configuration, as seen in FIGS. 1 and 2. Wheels 440*b* and 460*b* move to an extreme position within concave sides 260*a* and 360*a*, respectively, near front bar 320 when scissors assembly 200 is in the collapsed configuration.

Upper support assembly 600 mounted ton top of scissors assembly 400. Upper support assembly 600 includes front, rear and side structural members 620; 640; 660 and 680, respectively, as best seen in FIG. 8. These members 620; 640; 660 and 680 are mounted to form a rectangular frame to support sitting assemblies, such as, theater chairs, and the like.

Motor assembly 800 is preferably powered by an AC electrical source that is controlled with control unit 99. Control unit 99 selectively switches on and off the application to supply electrical power to motor assembly 800. Control unit 80 can also be wirelessly controlled and/or connected to LAN or WAN networks to facilitate its operation. Banks of mechanisms 100 can be controlled in parallel or individually, as desired, with suitable computerized means depending on the application.

Motor assembly 800 is implemented, in one of the preferred embodiments, with a single actuator drive motor assembly such as those commercialize by Limoss GmbH & Co. KG, Oberwengerner Straße 204, 58300 Wetter, Germany under model No. MD100, or equivalent. The end 920 of extendable arm 900 coupled to motor assembly 800 is hingedly mounted to bearing plates 580*a* and 580*b* with pin 590. Housing 82 of motor assembly 800 include bearing ears 820*a* and 820*b* that cooperate with spaced apart bearing plates 480*a* and 480*b* to allow pin 490 to pass therethrough keeping motor assembly 800 hingedly mounted to transversal member 480. In this manner, motor assembly 800 provides the necessary force to pull and push away transversal members 480 and 580 towards and away from each other. This in turn causes scissors assembly 400 to move from one extreme configuration (collapsed) to the other extreme configuration (fully extended). See FIGS. 16 and 17.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A raising mechanism for sitting assemblies, comprising:

A) a lower support assembly (200) resting on a substantially flat surface;

B) a scissors assembly (400) mounted over said lower support assembly (200) and adapted to move between a collapsed configuration and a fully extended configuration wherein said scissors assembly (400) includes first and second U-shape frames (420); (520) hingedly mounted to each other, said first frame (520) including two legs with distal ends and each having a rotatable wheel (540*b*); (560*b*) mounted thereon and cooperatively disposed to ride on said lower support assembly upon activation of said motor assembly (800), and wherein said U-frames (420) and (520) each include transversal members (480) and (580), respectively, and said arm (900) being pivotally mounted to said transversal member (580) and said motor assembly being mounted to said lower support assembly (200);

C) an upper support assembly (600) mounted on said scissors assembly (400) and kept at a substantially parallel and spaced apart relationship with respect to assembly (200); and D) a motor assembly (800) including a telescopically extendable arm (900) to cause said scissors assembly (400) to selectively move from said collapsible configuration to said fully extended configuration, said motor assembly (800) being mounted within said scissors assembly (400).

2. The mechanism set forth in claim 1 wherein said lower support assembly (200) further includes a transversal member (810) mounted within said lower support assembly (200) at a predetermined location to permit the full extension of said arm (900) for the raised configuration and fully retracting said arm (900) when said mechanism (100) is in the collapsed configuration.

* * * * *